US012173441B2

(12) United States Patent
Kim

(10) Patent No.: US 12,173,441 B2
(45) Date of Patent: Dec. 24, 2024

(54) WASHING MACHINE AND CONTROL METHOD OF WASHING MACHINE

(71) Applicant: LG Electronics Inc., Seoul (KR)

(72) Inventor: Han Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 307 days.

(21) Appl. No.: 17/624,705

(22) PCT Filed: Jun. 26, 2020

(86) PCT No.: PCT/KR2020/008389
§ 371 (c)(1),
(2) Date: Jan. 4, 2022

(87) PCT Pub. No.: WO2021/002639
PCT Pub. Date: Jan. 7, 2021

(65) Prior Publication Data

US 2022/0259785 A1 Aug. 18, 2022

(30) Foreign Application Priority Data

Jul. 4, 2019 (KR) ..... 10-2019-0080612

(51) Int. Cl.
*D06F 33/34* (2020.01)
*D06F 33/37* (2020.01)
(Continued)

(52) U.S. Cl.
CPC ..... *D06F 33/34* (2020.02); *D06F 33/37* (2020.02); *D06F 34/18* (2020.02); *D06F 37/36* (2013.01);
(Continued)

(58) Field of Classification Search
CPC ..... D06F 33/34; D06F 33/37; D06F 34/18; D06F 37/36; D06F 39/02; D06F 39/028;
(Continued)

(56) References Cited

U.S. PATENT DOCUMENTS

2005/0028298 A1* 2/2005 Kim ..... D06F 39/088 68/12.03
2005/0081308 A1 4/2005 Kim et al.
(Continued)

FOREIGN PATENT DOCUMENTS

CN 103562459 2/2014
CN 109944046 6/2019
(Continued)

OTHER PUBLICATIONS

Electronic translation of Kr 10-2017-0049213-A to Kim et al. (Year: 2017).*
(Continued)

*Primary Examiner* — Joseph L. Perrin
(74) *Attorney, Agent, or Firm* — Fish & Richardson P.C.

(57) ABSTRACT

A control method includes performing a first drum operation of supplying water by a first set amount together with a detergent into the tub and rotating the drum at a first drum rotation speed while water is supplied, operating the pump at a first pump rotation speed during the first drum operation, operating a heater to heat water in the tub, performing a second drum operation of rotating the drum at the first drum rotation speed during the operation of the heater, and operating the pump at a second pump rotation speed at least once during the second drum operation, stopping the operation of the heater, performing a third drum operation of rotating the drum at the first drum rotation speed, and operating the pump at the first pump rotation speed during the third drum operation.

19 Claims, 8 Drawing Sheets

(51) Int. Cl.

| | |
|---|---|
| ***D06F 34/18*** | (2020.01) |
| ***D06F 37/36*** | (2006.01) |
| ***D06F 39/02*** | (2006.01) |
| ***D06F 39/04*** | (2006.01) |
| ***D06F 39/08*** | (2006.01) |
| ***D06F 103/04*** | (2020.01) |
| ***D06F 105/02*** | (2020.01) |
| ***D06F 105/14*** | (2020.01) |
| ***D06F 105/28*** | (2020.01) |
| ***D06F 105/48*** | (2020.01) |

(52) U.S. Cl.
CPC ..... *D06F 39/028* (2013.01); *D06F 39/04* (2013.01); *D06F 39/08* (2013.01); *D06F 39/085* (2013.01); *D06F 2103/04* (2020.02); *D06F 2105/02* (2020.02); *D06F 2105/14* (2020.02); *D06F 2105/28* (2020.02); *D06F 2105/48* (2020.02)

(58) Field of Classification Search
CPC ..... D06F 39/04; D06F 39/08; D06F 39/085; D06F 2103/04; D06F 2015/02; D06F 2015/14; D06F 2015/28; D06F 2015/48
See application file for complete search history.

(56) References Cited

U.S. PATENT DOCUMENTS

| | | | | |
|---|---|---|---|---|
| 2009/0056037 | A1 | 3/2009 | Lee et al. | |
| 2013/0200833 | A1 | 8/2013 | Yoo et al. | |
| 2015/0299926 | A1 | 10/2015 | Kim et al. | |
| 2019/0136438 | A1* | 5/2019 | Lee | D06F 37/04 |
| 2019/0203400 | A1 | 7/2019 | Jung et al. | |
| 2019/0226136 | A1* | 7/2019 | Lee | D06F 39/088 |
| 2020/0040505 | A1* | 2/2020 | Jang | D06F 39/087 |

FOREIGN PATENT DOCUMENTS

| | | | |
|---|---|---|---|
| EP | 2792779 | | 10/2014 |
| JP | 2012-170694 | A | 9/2012 |
| KR | 10-2017-0049213 | | 5/2017 |
| KR | 10-2018-0072336 | | 6/2018 |
| KR | 10-2018-0076562 | | 7/2018 |
| KR | 10-2018-0076565 | | 7/2018 |
| KR | 10-2019-0006057 | A | 1/2019 |
| WO | WO 2018/066970 | | 4/2018 |
| WO | WO 2018/066971 | | 4/2018 |

OTHER PUBLICATIONS

Electronic translation of KR 10-2018-0072336 A to Im et al. (Year: 2018).*
Office Action in Australian Appln. No. 2020299055, mailed on Jun. 27, 2023, 7 pages.
International Search Report in International Appln. No. PCT/KR2020/008389, mailed on Oct. 20, 2020, 6 pages (with English translation).
Office Action in Chinese Appln. No. 202080048567.X, mailed on Mar. 23, 2023, 22 pages (with English translation).
Extended European Search Report in European Appln. No. 20834691.6, mailed on Jun. 19, 2023, 8 pages.
Office Action in Korean Appln. No. 10-2019-0080612, mailed on Aug. 23, 2024, 13 pages (with English Translation).

* cited by examiner

FIG. 6

| cycle | washing cycle(S1) | | | first rinsing cycle(S2) | | second rinsing cycle(S3) | | spin-dry cycle(S4) | |
|---|---|---|---|---|---|---|---|---|---|
| | washing water supply (S11) | heat washing(S12) | post-washing(S13) | rinse and spin-dry (S21) | water supply(S22) | rinsing and spin-drying (S31) | water supply(S32) | main spin-dry(S41) | cloth unwind(S42) |
| time | 5minutes | 8minutes | 43minutes | 11minutes | 4minutes | 5minutes | 3minutes | 13minutes | 1minutes |
| drum operation method | tumbling | tumbling | tumbling | spin-dry rotation | tumbling | spin-dry rotation | tumbling | spin-dry rotation | tumbling |
| drum rotation speed (rpm) | 46 | 46 | 46 | 600 | 46 | 600 | 46 | 750 | 46 |
| actual operation rate of washing motor | 7"/8" | 17"/18" | 24"/10" | | 21"/9" | | 21"/9" | | 7"/3" |
| actual operation rate of circulation pump | synchronization with washing motor | pump on-synchronization with washing motor | 8"/10" | | 23"/12" | | 23"/12" | | |
| circulation pump operation method | constant speed operation, 0.6A | constant speed operation, 0.6A | constant speed operation, 0.8A | | constant speed operation, 0.8A | | constant speed operation, 0.6A | | |
| water supply amount(l) | 27 | | | 37 | | 36 | | | |

FIG. 8

| cycle | washing cycle(S1) | | | | first rinsing cycle(S2) | | | second rinsing cycle(S3) | | | spin-dry cycle(S4) | |
|---|---|---|---|---|---|---|---|---|---|---|---|---|
| | washing water supply (S11) | heat washing(S12) | post-washing(S13) | simple rinsing(S14) | rinse and spin-dry (S21) | water supply(S22) | rinsing(S23) | rinsing and spin-drying (S31) | water supply(S32) | rinsing(S33) | main spin-dry(S41) | cloth crumpling(S42) |
| time | 5minutes | 18minutes | 130minutes | 1minutes | 2minutes | 6minutes | 1minutes | 5minutes | 6minutes | 1minutes | 15minutes | 1minutes |
| drum operation method | tumbling | tumbling | tumbling | | spin-dry rotation | tumbling | tumbling | spin-dry rotation | tumbling | tumbling | spin-dry rotation | tumbling |
| drum rotation speed (rpm) | 46 | 46 | 46 | | 750 | 46 | 46 | 750 | 46 | 46 | 750 | 46 |
| actual operation rate of washing motor | 7"/8" | 12"/18" | 16 /10" | | | 3"/8" | 3"/8" | | 3"/8" | 3"/8" | | 7"/8" |
| actual operation rate of circulation pump | synchronization with washing motor | same as synchronization with washing motor | 10"/9" | | | 23"/12" | 23"/12" | | 23"/12" | 23"/12" | | 7"/8" |
| circulation pump operation method | constant speed operation, 0.8A | constant speed operation, 0.8A | constant speed operation, 0.8A | | | constant speed operation, 0.8A | constant speed operation, 0.8A | | constant speed operation, 0.8A | constant speed operation, 0.8A | | |
| water supply amount(l) | 44 | | | | 52 | | | 47 | | | | |

WASHING MACHINE AND CONTROL METHOD OF WASHING MACHINE

CROSS-REFERENCE TO RELATED APPLICATIONS

This application is a National Stage application under 35 U.S.C. § 371 of International Application No. PCT/KR2020/008389, filed on Jun. 26, 2020, which claims the benefit of Korean Patent Application No. 10-2019-0080612, filed on Jul. 4, 2019. The disclosures of the prior applications are incorporated by reference in their entirety.

BACKGROUND OF THE DISCLOSURE

Field of the Disclosure

The present disclosure relates to a washing machine and a control method of a washing machine, and more particularly, to a washing machine in which washing performance is improved by controlling a speed of a circulation pump, and a control method of a washing machine.

Related Art

Japanese Patent Application Laid-Open No. 2010-36016 (hereinafter referred to as a "related art") discloses a washing machine having a rotating drum installed in a water tank and having a circulation pump for circulating water discharged from the water tank.

Meanwhile, for effective washing, it is important to spray the circulating water in an appropriate pattern through an operation control of the circulation pump in addition to physical actions such as a fall of the laundry caused by the rotation of the drum and friction between the laundry and the drum or lifter, and it is necessary to optimize a washing method according to the amount of laundry.

SUMMARY

The present disclosure provides a control method of a washing machine to improve washing performance by allowing detergent water to be effectively applied to laundry.

The present disclosure also provides a control method of a washing machine in which detergent water having a high concentration may be evenly applied to laundry during soaking at an initial stage of washing.

The present disclosure also provides a control method of a washing machine to simultaneously apply heat and chemical action based on high-temperature detergent water and mechanical force based on drum rotation to laundry at an initial stage of washing.

The present disclosure also provides a control method of a washing machine that optimizes a washing method according to the amount of laundry.

The present disclosure relates to a washing machine having a drum rotating in a tub and a nozzle spraying water discharged from the tub and circulated by a pump into the drum, and a control method of a washing machine.

The washing machine may include a tub for storing water, a drum rotatably provided in the tub, a driving unit rotating the drum, a water supply unit supplying water supplied from an external water source to the tub, a pump having a pump motor and pressure-feeding water discharged from the tub, a nozzle spraying the water pressure-fed by the pump into the drum, a heater heating the water in the tub, and a controller controlling the driving unit, the water supply unit, and the pump motor, and the heater.

The washing machine may further include a casing forming an exterior of the washing machine. The tub may be disposed in the casing. The casing may include a cabinet having an open front surface, a left surface, a right surface, and a rear surface.

A central axis of rotation on which the drum rotates may be disposed on a straight line passing through the rear surface of the cabinet. The drum may be rotated about a horizontal axis of rotation in the tub.

The nozzle may be provided in plurality.

The water supply unit may include a water supply pipe receiving water from an external water source, a water supply valve controlling the water supply pipe, and a dispenser accommodating a detergent. The dispenser may be connected to the water supply pipe and the tub.

The controller may control the water supply unit to supply water by a first set amount to the tub. The controller may control the driving unit so that the drum rotates at a first drum rotation speed while water is supplied. The controller, while the drum rotates at the first drum rotation speed, may rotate the pump motor at a first pump rotation speed. When supplying water to the tub, the controller may rotate the drum at least once at the first drum rotation speed, may rotate the pump motor at least once at the first pump rotation speed, and may control rotation of the pump motor and rotation of the drum to be synchronized with each other. When supplying the water by the first set amount to the tub, the controller may control the water supply valve to supply the water supplied to the water supply pipe to the tub via the dispenser. When water is supplied to the tub by the first set amount, the detergent accommodated in the dispenser and water may be supplied to the tub together.

The controller may operate the heater in a state in which the first set amount of water is supplied to the tub. The controller may control the driving unit to rotate the drum at the second drum rotation speed, while operating the heater. The controller may operate the pump motor at a second pump rotation speed while the heater is operated and the drum rotates at the second drum rotation speed. The controller may control the start of the pump motor to be synchronized with the start of rotation of the drum when the heater is operated. When the heater is operated, a ratio of a stop time of the drum to a rotation time of the drum may be greater than a ratio of a stop time of the drum to a rotation time of the drum when water is supplied to the tub.

The controller may stop the operation of the heater. The controller may control the driving unit to rotate the drum at the third drum rotation speed in a state in which the operation of the heater is stopped. The controller may rotate the pump motor at the third pump rotation speed while the operation of the heater is stopped and the drum rotates at the third drum rotation speed. A ratio of a stop time of the drum to a rotation time of the drum in a state in which the heater is stopped may be smaller than a ratio of a stop time of the drum to a rotation time of the drum when the heater is operated.

The first drum rotation speed, the second drum rotation speed, and the third drum rotation speed may be the same as each other. The first, second, and third drum rotation speeds may be the speeds at which laundry located at the lowest point in the drum rises to a certain height by rotation of the drum and then falls apart from an inner surface of the drum.

The first pump rotation speed and the third pump rotation speed may be the same as each other.

The water supply unit may include a water supply pipe receiving water from an external water source, a water supply valve controlling the water supply pipe, and a dispenser accommodating a detergent and connected to the water supply pipe and the tub.

The controller may control the water supply valve to supply water supplied to the water supply pipe to the tub via the dispenser when water is supplied to the tub by the first set amount. When water is supplied to the tub by the first set amount, the detergent accommodated in the dispenser and water may be supplied to the tub together.

The controller may detect the amount of laundry put into the drum and control a rotation time of the drum based on the detected amount of laundry. When the detected amount of laundry is a first laundry amount, the controller may rotate the drum at the second drum rotation speed for a first time during operation of the heater, and when the detected amount of laundry is a second laundry amount greater than the first laundry amount, the controller may rotate the drum at the second drum rotation speed for a second drum driving time greater than the first drum driving time during the operation of the heater. When the detected amount of laundry is the first laundry amount, the controller may rotate the pump motor for a first pump driving time while the operation of the heater is stopped, and when the detected amount of amount is the second laundry amount greater than the first laundry amount, the controller may rotate the pump motor for a second pump driving time greater than the first pump driving time. The controller may control the driving unit such that a ratio of the stop time of the drum to the rotation time of the drum in a state in which the operation of the heater is stopped, when the detected amount of laundry is the second laundry amount is greater than a ratio of a stop time of the drum to a rotation time of the drum in a state in which the operation of the heater is stopped when the detected amount of the laundry is the first laundry amount.

The control method may include: (a) step of performing a first drum operation of supplying water by a first set amount together with a detergent into the tub and rotating the drum at a first drum rotation speed, while water is supplied, at least once and operating the pump at a first pump rotation speed at least once during the first drum operation; (b) step of operating a heater to heat water in the tub, performing a second drum operation of rotating the drum at the first drum rotation speed during the operation of the heater at least once, and operating the pump at a second pump rotation speed at least once during the second drum operation; and (c) step of stopping the operation of the heater, performing a third drum operation of rotating the drum at the first drum rotation speed at least once, and operating the pump at the first pump rotation speed at least once during the third drum operation.

In step (a), the operation of the pump may be controlled to be synchronized with the rotation of the drum.

In step (b), the start of the pump may be controlled to be synchronized with the start of the rotation of the drum.

While the drum is rotated at the first drum rotation speed, the laundry located at the lowest point in the drum may rise to a certain height by the rotation of the drum and then may be separated from an inner surface of the drum and fall.

The ratio of the stop time of the drum to the operation time of the drum in step (b) may be greater than the ratio of the stop time of the drum to the operation time of the drum in step (a).

The ratio of the stop time of the drum to the operation time of the drum in step (c) may be smaller than the ratio of the stop time of the drum to the operation time in step (b).

Alternatively, a control method of a washing machine includes: (a) detecting the amount of laundry introduced into the drum; and (b) performing a first washing mode when the detected amount of laundry is a first laundry amount, and performing a second washing mode when the detected amount of laundry is a second laundry amount, wherein the first washing mode includes (c-1) a step of supplying water by a first set amount together with a detergent into the tub, performing a first drum operation of rotating the drum at a first drum rotation speed, while water is supplied, at least once, and operating the pump at a first pump rotation speed at least once during the first drum operation, (c-2) a step of operating a heater to heat water in the tub, performing a second drum operation of rotating the drum at the first drum rotation speed at least once during the operation of the heater, and operating the pump at a second pump rotation speed during the second drum operation, and (c-3) a step of performing a third drum operation of rotating the drum at the first drum rotation speed at least once and operating the pump at the first pump rotation speed at least once during the second drum operation, and the second washing mode includes (d-1) a step of supplying water by a first set amount together with a detergent into the tub, performing a first drum operation of rotating the drum at the first drum rotation speed at least once, while water is supplied, and operating the pump at a first pump rotation speed at least once during the first drum operation, (d-2) a step of operating the heater to heat water in the tub, performing a second drum operation of rotating the drum at the first drum rotation speed at least once during the operation of the heater, and operating the pump at a second pump rotation speed at least once during the second drum operation, for a time longer than (c-2), and (d-3) a step of stopping the operation of the heater, performing a third drum operation of rotating the drum at the first drum rotation speed at least once, and operating the pump at the first pump rotation speed at least once during the second drum operation, for a time longer than that in step (c-3), wherein a ratio of a stop time of the drum to a rotation time of the drum is greater than that of the case of the step (c-3).

Advantageous Effects

First, the control method of a washing machine of the present disclosure has the effect of evenly applying the detergent water to the laundry in the drum by performing speed shifting operation on the circulation pump in the process of supplying the detergent water.

Second, since heating is performed in a state in which the detergent is evenly permeated into the laundry, heat and chemical action may directly affect the laundry, thereby improving washing power.

Third, by classifying a case in which the amount of laundry is large and a case in which the amount of laundry is small and differentiating control methods for a washing motor and a pump motor, an optimum washing power may be derived and energy consumption may be optimized.

BRIEF DESCRIPTION OF THE DRAWINGS

FIG. 6 is a table summarizing data referenced to describe a control method of a washing machine according to an embodiment of the present disclosure.

FIG. 8 is a table summarizing data referenced to describe a control method of a washing machine according to another embodiment of the present disclosure.

DESCRIPTION OF EXEMPLARY EMBODIMENTS

Figure 1:
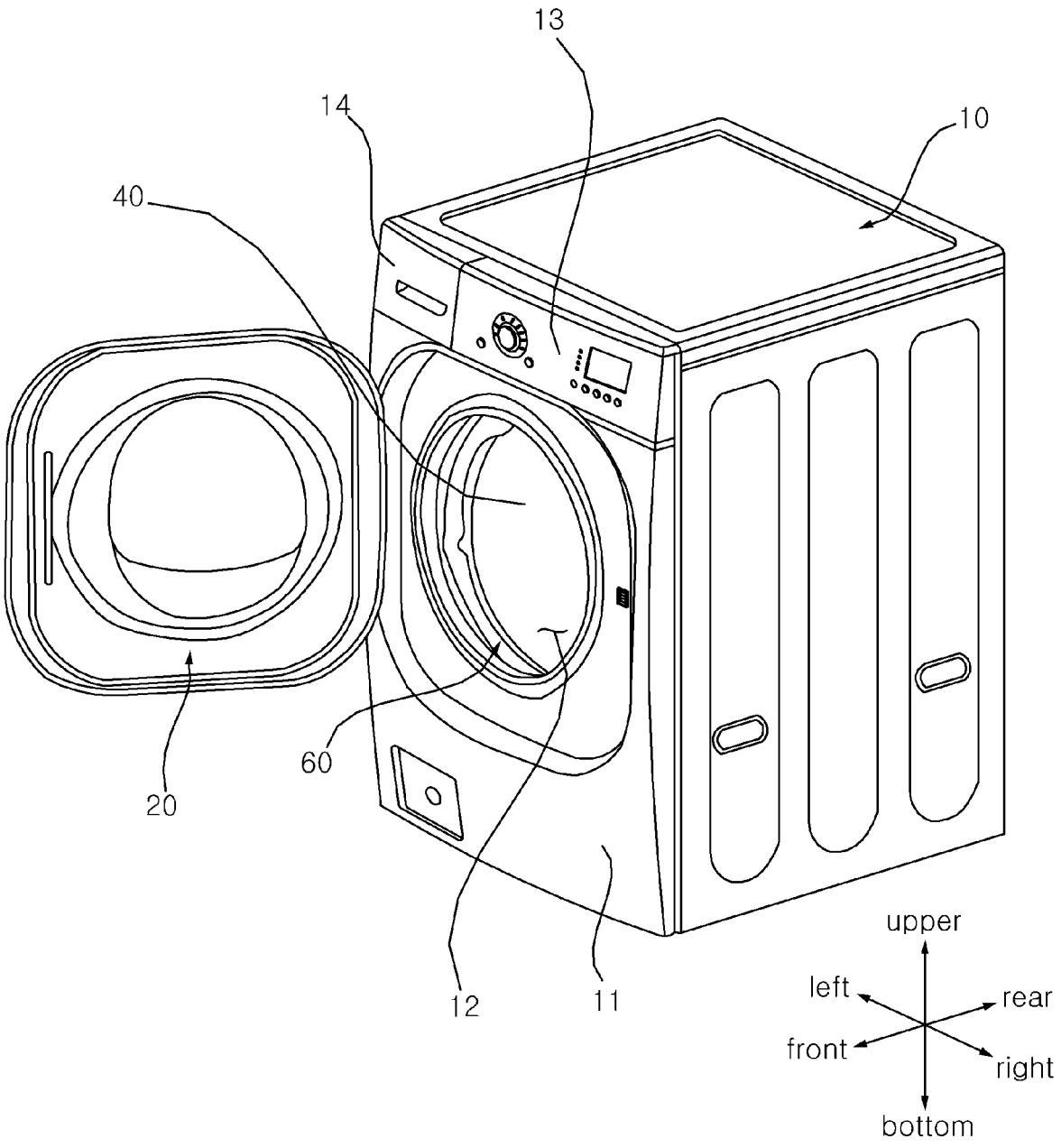
FIG. 1 is a perspective view illustrating a washing machine according to an embodiment of the present disclosure.

Advantages and features of the invention and methods to achieve the same are described more fully hereinafter with reference to the accompanying drawings in which embodiments are shown. This invention may, however, be embodied in many different forms and should not be construed as limited to the embodiments set forth herein. Rather, these embodiments are provided so that this disclosure is thorough, and will fully convey the scope of the invention to those skilled in the art and this invention is defined by the scope of the claims. Like reference numerals refer to like elements throughout the present specification.

Hereinafter, the present disclosure will be described in detail with reference to the accompanying drawings.

Figure 2:
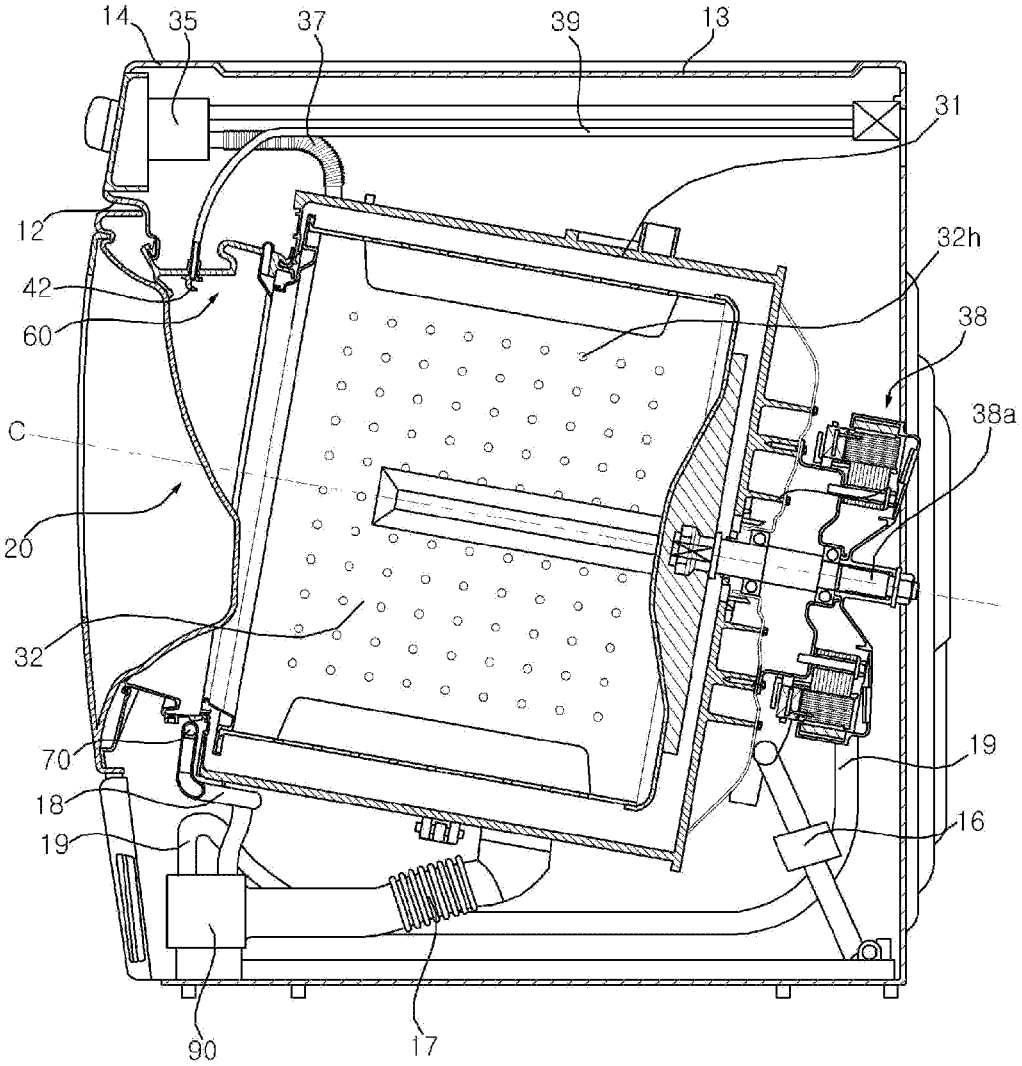
FIG. 2 is a side cross-sectional view illustrating an inside of the washing machine illustrated in FIG. 1.
Figure 3:
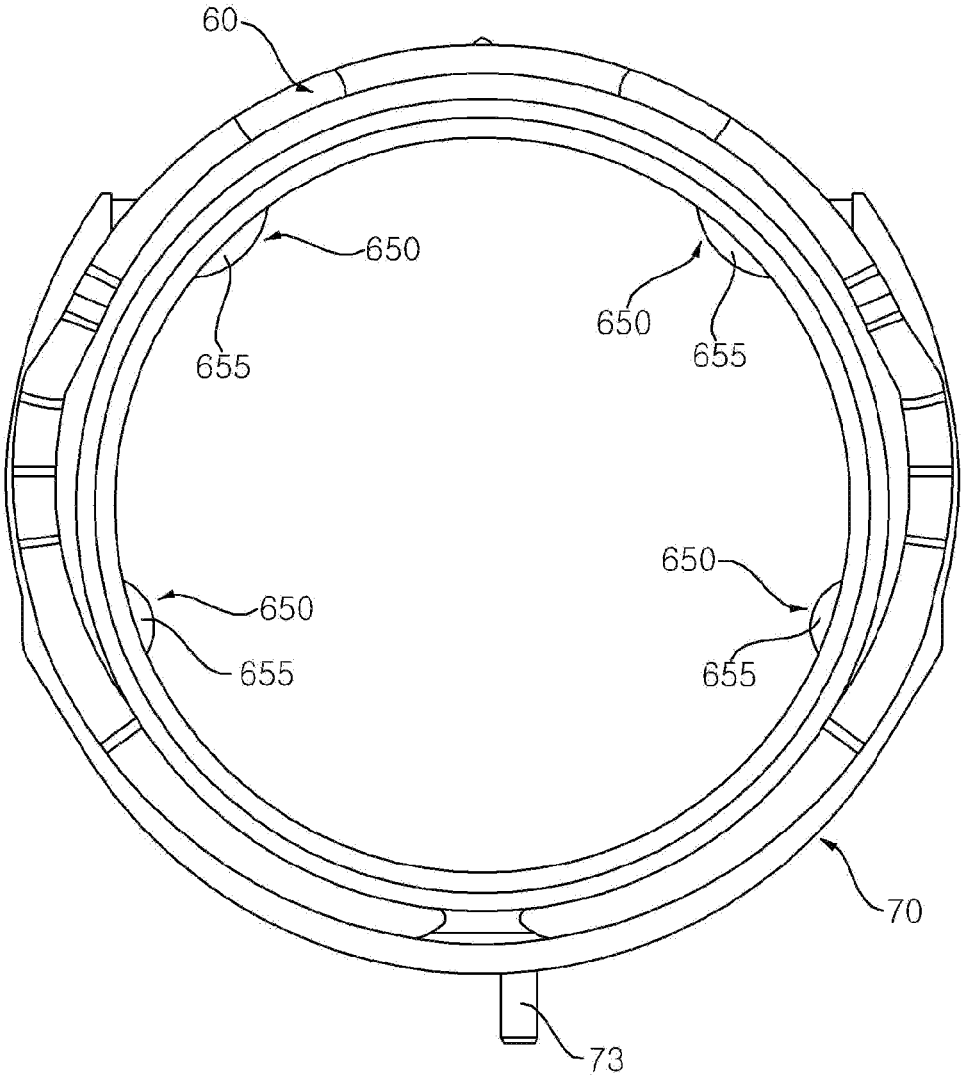
FIG. 3 is a perspective view illustrating a coupling state of a gasket and a distribution pipe illustrated in FIG. 2.
Figure 4:
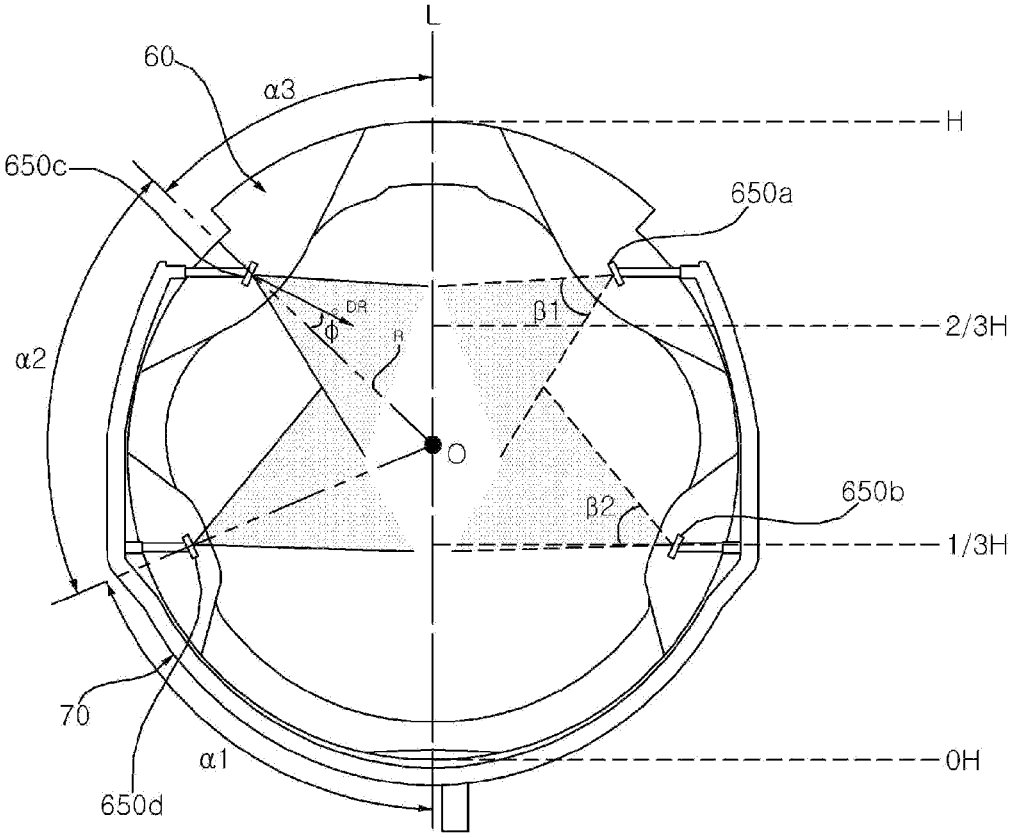
FIG. 4 is a rear view of a gasket, illustrating positions of nozzles and a spray form of each nozzle.

FIG. 1 is a perspective view illustrating a washing machine according to an embodiment of the present disclosure. FIG. 2 is a side cross-sectional view illustrating an inside of the washing machine illustrated in FIG. 1. FIG. 3 is a perspective view illustrating a coupling state of a gasket and a distribution pipe illustrated in FIG. 2. FIG. 4 is a rear view of a gasket, illustrating positions of nozzles and a spray form of each nozzle.

Referring to FIGS. 1 to 3, a casing 10 forms an exterior of a washing machine, and an inlet 12*h* through which laundry is put is formed on a front surface. The casing 10 may include a cabinet 11 having an open front surface, a left surface, a right surface, and a rear surface and a front panel 12 coupled to the open front surface of the cabinet 11 and having the inlet 12*h* formed therein. Bottom and top surfaces of the cabinet 11 are open, and a horizontal base 15 supporting the washing machine may be coupled to the bottom surface. In addition, the casing 10 may further include a top plate 13 covering the open upper surface of the cabinet 11 and a control panel 14 disposed above the front panel 12.

A tub 31 containing water may be disposed inside the casing 10. The tub 31 has an entrance formed in the front so that laundry may be put therein. The cabinet 11 and the tub 31 are connected by an annular gasket 60. A door 20 for opening and closing the inlet 12*h* may be rotatably coupled to the casing 10.

A heater 29 for heating wash water may be provided in the tub 31. The heater 29 may be disposed outside the drum 31.

The gasket 60 is to prevent water contained in the tub 31 from leaking. The gasket 60 may extend from an annular front end to an annular rear end of the to form a tubular passage connecting the inlet 12*h* and the inlet of the tub 41. The front end of the gasket 60 may be fixed to the front panel 12 of the casing 10, and the rear end may be fixed around the entrance of the tub 31.

The gasket 60 may be formed of a flexible or elastic material. The gasket 60 may be formed of natural rubber or synthetic resin. The gasket 60 may be formed of a flexible material such as rubber. The gasket 60 may be formed of a material such as ethylene propylene diene monomer (EPDM) or thermo plastic elastomer (TPE). Hereinafter, a portion defining the inside of the tubular shape of the gasket 60 is referred to as an inner circumferential portion (or an inner circumferential surface) of the gasket 60, and the opposite portion is referred to as an outer circumferential portion (or an outer surface) of the gasket 60.

A drum 32 accommodating laundry may be rotatably provided in the tub 31. A plurality of through-holes 32*h* may be formed in the drum 32 so that water in the tub 31 may be introduced into the drum 32.

The drum 32 is arranged so that the entrance into which the laundry is put is located at the front, and rotates about a substantially horizontal rotation center line C. However, "horizontal" is not a term used in a mathematically strict sense. That is, the rotation center line C inclined at a predetermined angle with respect to the horizontality as in the embodiment may be considered as being substantially horizontal because it is also closer to horizontality rather than verticality. In other words, the rotation center line C may pass through the rear surface of the cabinet 11.

A plurality of lifters 34 may be provided on an inner surface of the drum 32. The plurality of lifters 34 may be disposed at a predetermined angle with respect to a center of the drum 32. When the drum 32 rotates, the laundry is lifted by the lifter 34 and then dropped repeatedly.

A driving unit 38 for rotating the drum 32 may be further provided, and a drive shaft 38*a* rotated by the driving unit 38 may pass through a rear surface of the tub 31 and be coupled to the drum 32.

Preferably, the driving unit 38 may include a direct-connected washing motor, and the washing motor may include a stator fixed to the rear of the tub 31 and a rotor rotated by magnetic force acting between the rotor and the stator. The drive shaft 38*a* may rotate integrally with the rotor.

The tub 31 may be supported by a damper 16 installed on the base 15. Vibration of the tub 31 induced when the drum 32 rotates is attenuated by the damper 16. Although not shown, according to the embodiment, a hanger (e.g., a spring) for suspending the tub 31 in the casing 10 may be further provided.

The water supply unit may supply water supplied from an external water source such as a faucet to the tub 31 or the drum. The water supply unit may include a water supply hose (not shown) for guiding water supplied from an external water source such as a faucet, a water supply pipe 34 for guiding the water supplied through the water supply hose to a dispenser 35, and a water supply valve 33 intermittently controlling the water supply pipe 34.

The dispenser 35 supplies additives such as detergent and fabric softener into the tub 31 or the drum 32. In the dispenser 35, additives may be classified and accommodated according to their types. The dispenser 35 may include a detergent accommodating portion (not shown) for accommodating the detergent and a softener accommodating portion (not shown) for accommodating the fabric softener.

The water supply pipe 34 may include at least one water supply pipe (not shown) for selectively guiding water supplied through the water supply valve 33 to each accommodating portion of the dispenser 35.

The gasket 60 may include a direct water nozzle 42 for spraying water into the drum 32, and a direct water supply pipe 39 for guiding the water supplied through the water supply valve 33 to the direct water nozzle 42.

Water discharged from the dispenser 35 is supplied to the tub 31 through a water supply bellows 37. A water supply port (not shown) connected to the water supply bellows 37 may be formed on a side surface of the tub 31.

A drain hole for discharging water may be formed in the tub 31, and a drain bellows 17 may be connected to the drain hole. A pump 90 for pumping water discharged from the tub 31 through the drain bellows 17 may be provided. A drain valve (not shown) for controlling the drain bellows 17 may be further provided.

In the embodiment, the pump 90 is a circulation pump for drainage and selectively performs a function of pressure-feed water discharged through the drainage bellows 17 to a drain pipe 19 and a function of pressure-feed water to a circulation pipe 18. Since a technique of selectively performing circulation and drainage using a single pump is already well known in the washing machine technology field, a detailed description thereof will be omitted.

However, the present disclosure is not limited thereto, and a drain pump for pressure-feeding water to the drain pipe 19 and a circulation pump for pressure-feeding water to the circulation pipe 18 may be provided separately.

Hereinafter, water pressure-fed by the pump 90 and guided along the circulation pipe 18 is referred to as circulating water.

The pump 90 enables a variable flow rate (or discharge water pressure). A pump motor (not shown) rotating an impeller (not shown) of the pump 90 may be a variable speed motor enabling controlling of a rotation speed. The pump motor may be a brushless direct current motor (BLDC), but is not necessarily limited thereto. A driver for controlling a speed of the pump motor may be further provided, and the driver may be an inverter driver. The inverter driver converts AC power into DC power and inputs the DC power to the motor at a target frequency.

A controller (not shown) for controlling the pump motor may be further provided. The controller may include a proportional-integral (PI) controller, a proportional-integral-derivative (PID) controller, and the like. The controller may receive an output value (e.g., output current) of the pump motor as an input, and control an output value of the driver so that a rotation speed of the pump motor follows a preset target rotation speed based thereon. The controller may control not only the rotation speed of the pump motor, but also a rotation direction.

Meanwhile, it should be understood that the controller may control an overall operation of the washing machine as well as the pump motor and each portion mentioned below is controlled by the controller.

Meanwhile, a nozzle 650 may be disposed on an inner circumferential surface of the gasket 60. The nozzles 650 may be provided in plurality. A plurality of protrusions 655 may be formed on an inner circumferential surface of the gasket 60, and nozzles 650*a*, 650*b*, 650*c*, and 650*d* may be formed on the protrusions 655, respectively.

A distribution pipe 701 for guiding the circulating water pressure-fed by the pump 90 to the plurality of nozzles 650 may be installed in the gasket 60. The distribution pipe 701 may have an entrance connected to the circulation pipe 18 and may have a plurality of exits for guiding water guided through the entrance to the plurality of nozzles 650.

The plurality of nozzles 650 may be classified into upper nozzles 650*a* and 650*c* and lower nozzles 650*b* and 650*d* according to a height from the gasket 60. In the embodiment, four nozzles 650*a*, 650*b*, 650*c*, and 650*d* are provided, which may include a first lower nozzle 650*b* and a second lower nozzle 650*d* disposed below the gasket 60 and a first upper nozzle 650*a* and a second upper nozzle 650*c* disposed above the lower 650*b* and 650*d*.

A water flow injected through each of the nozzles 650*a*, 650*b*, 650*c*, and 650*d* reaches a deeper portion of the drum 32 as water pressure supplied from the pump 90 is higher. That is, by controlling a rotation speed of the pump motor (hereinafter referred to as 'pump rotation speed'), a range of the water flow sprayed from the nozzles 650*a*, 650*b*, 650*c*, and 650*d* in the drum 32 may be controlled.

Referring to FIG. 4, when a spray width of a water stream sprayed through the nozzle 650 is defined as a spray width angle, a spray width angle $\beta 1$ of the upper nozzles 650*a* and 650*c* may be smaller than a spray width angle $\beta 2$ of the lower nozzles 650*b* and 650*d*.

A difference ($\beta 2-\beta 1$) between the spray width angle $\beta 2$ of the lower nozzles 650*b* and 650*d* and the spray width angle $\beta 1$ of the upper nozzles 650*a* and 650*c* is approximately 4 to 6 degrees, and preferably 5 degrees. At this time, $\beta 1$ is approximately 38 to 42 degrees, preferably 40 degrees, and $\beta 2$ is approximately 43 to 47 degrees, preferably 45 degrees.

Meanwhile, a spray direction of the upper nozzles 650*a* and 650*c* may form an upward deviation angle $\Phi$ upwardly with respect to a line (R, hereinafter, referred to as a 'nozzle arrangement line') connecting the upper nozzles 650*a* and 650*c* and the center O of the gasket 650*a*. The upward deviation angle $\Phi$ may be 5 to 9 degrees, preferably 7 degrees.

Due to various conditions such as the height, position, and spray width angle $\beta 1$ of the upper nozzles 650*a* and 650*c*, in some cases, the spray is not performed with sufficient water pressure through the upper nozzles 650*a* and 650*c*, so the sprayed water flow may not be able to go straight to a distance. For this reason, by making a spray direction of the upper nozzles 650*a* and 650*c* upward by an upward deviation angle $\Phi$ from the nozzle arrangement line R, even when the water pressure of the upper nozzles 650*a* and 650*c* is insufficient, the water flow may reach a region that the nozzle arrangement line (R) passes through, and preferably, a shape of the water flow sprayed through the upper nozzles 650*a* and 650*c* as shown in FIG. 17 and a shape of the water flow sprayed through the lower nozzles 650*b* and 650*d* may be substantially symmetrical up and down.

Meanwhile, assuming that an angle from the lowest point of the gasket 60 to the lower nozzles 650*b* and 650*d* is $\alpha 1$, the upper nozzles 650*a* and 650*c* are between a highest point H of the gasket 60 from a position corresponding to the angle $\alpha 1$ but it may be located above a point corresponding to an angle obtained by dividing 180-$\alpha 1$ into equal parts. That is, in FIG. 4, $\alpha 2$ has a larger value than $\alpha 3$. $\alpha 2-\alpha 3$ may be 18 degrees to 22 degrees, preferably 20 degrees. In this case, $\alpha 2$ may be 63 degrees to 67 degrees, preferably 65 degrees.

Meanwhile, the lower nozzles 650*b* and 650*d* may be positioned at about ⅓ point (⅓H) of the height H of the gasket 60. In this case, $\alpha 2$ is preferably set in a range in which the upper nozzles 650*a* and 650*c* are located higher than ⅔ (⅔H) of the height of the gasket 60. In this case, $\alpha 2$ may be 65 degrees.

In order to evenly spray the circulating water up and down in the drum 32, the upper nozzles 650*a* and 650*c* and the lower nozzles 650*b* and 650*d* are preferably arranged at equal intervals in the height direction, but in this case, there is a problem in that the water flow sprayed from the upper nozzles 650*a* and 650*c* actually reaches a lower region than that geometrically predicted due to deflection of the water flow. Therefore, when considering the deflection of the water flow due to gravity, the upper nozzles 650*a* and 650*c* need to be disposed higher than ⅔H.

Meanwhile, when the pump 901 is operated and the circulating water is sprayed through the lower nozzles 650*b* and 650*d*, a water level in the tub 31 preferably does not exceed the ⅓H point.

The method for controlling a washing machine according to the present disclosure may include detecting the amount of laundry put into the drum 32, and a first washing mode and a second washing mode may be selectively performed according to the detected amount of laundry. Here, the first washing mode is performed when the detected amount of laundry is a first laundry amount (e.g., middle amount of cloth), and when the detected amount of laundry is a second laundry amount (e.g., large amount of cloth) that is greater than the first laundry amount, the second washing mode is performed.

Hereinafter, the first washing mode will be described with reference to FIGS. 5 and 6, and the second washing mode will be described with reference to FIGS. 7 to 8.

Figure 5:
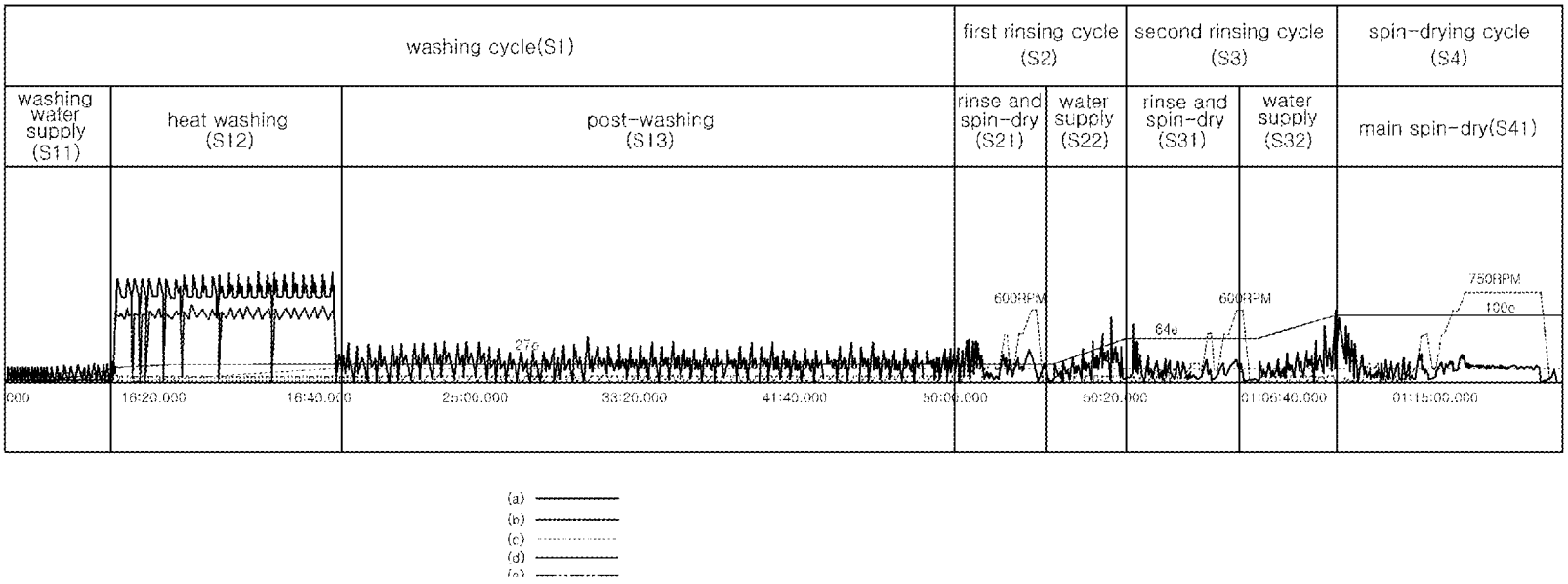
FIG. 5 is graphs referenced to describe a control method of a washing machine according to an embodiment of the present disclosure.

FIG. 5 is graphs referenced to describe a control method (the first washing mode) of a washing machine according to an embodiment of the present disclosure, in which (a) is current (W), (b) is electric power, C is a rotation speed of the drum, (d) is the amount of supplied water, and (e) represents electrical energy Wh. In particular, the current a, the electric power c, and the electrical energy Wh indicate a total amount consumed by the washing motor, the pump motor, and the heater 29.

FIG. 6 is a table summarizing data referenced to describe a control method (the first washing mode) of a washing machine according to an embodiment of the present disclosure. Hereinafter, a control method of a washing machine according to an embodiment of the present disclosure will be described with reference to FIGS. 5 and 6.

The control method of a washing machine according to an embodiment of the present disclosure may include a washing cycle (S1), a first rinsing cycle (S2), a second rinsing cycle (S3), and a spin-drying cycle (S4).

The first washing cycle (S1) may include washing water supply (S11), heat washing (S12), and post-washing (S13). The washing water supply (S11) is a step of supplying water into the tub 31, in which the water supply valve 33 is opened under the control of a controller (not shown). Water is supplied to the dispenser 35 through the water supply pipe 34, and the additive (detergent) contained in the dispenser 35 may be discharged together with the water.

The controller may control various electric devices constituting the washing machine and may include a memory for storing a coded program and a processor for processing data by reading the memory. Hereinafter, it should be understood that 'control' is performed by the controller even if there is no particular mention.

At the time of washing water supply (S11), a first set amount (e.g., 27 liters (l)) of water is supplied into the tub 31, and a first drum operation is performed while the water is supplied in this manner. During the first drum operation, rotating the drum 32 at a first drum rotation speed (46 rpm in the table of FIG. 6) is performed at least once. In addition, operating the pump 90 at a first pump rotation speed during the first drum operation may be performed at least once. When a current of 0.8 A is applied to the pump motor, the pump motor may be rotated at a first pump rotation speed. A time required for the washing water supply (S11) may be about 5 minutes.

While the drum 32 is rotated at the first drum rotation speed, the laundry located at the lowest point in the drum 32 may rise to a certain height by the rotation of the drum 32 and may be separated from the inner surface of the drum 32 to fall. Hereinafter, this type of laundry flow is referred to as a tumbling motion.

The rotation of the drum 32 (i.e., rotation at the first drum rotation speed) during the washing water supply (S11) may be repeated a plurality of times. In this case, a ratio (t11:t12) of the time t11 for which the drum 32 is rotated once and the time t12 for which the drum 32 is stopped once may be 7:8. For example, a pattern in which current is applied to the washing motor for 7 seconds and then cut off for 8 seconds may be repeated.

The rotation of the pump motor may be controlled to be synchronized with the washing motor. That is, the pump motor may be started in response to the starting of the washing motor, and the pump motor may also be stopped in response to the stopping of the washing motor.

Heat washing (S12) may be performed in a state in which the first set amount of water is supplied into the tub 31 by the washing water supply (S11). During heat washing (S12), the heater 29 is operated, and the second drum operation is performed while the heater 29 is operated. In the second drum operation, the drum 32 may be rotated at the same speed (a first drum rotation speed) as in the first drum operation.

During heat washing (S12), a ratio (t22/t21=18/12) of one stop time (t22) to one rotation time (t21) of the drum 32 may be greater than a value (8/7) at the time of washing water supply (S11). Since the heater 29 consumes a large amount of current during heat washing (S12), an operation rate of the washing motor is lowered (that is, a ratio of the one-time stop time of the washing motor is increased) to suppress consumption of total power.

During heat washing (S12), the start of the pump 90 may be controlled to be synchronized with the start of rotation of the drum 32. The one-time operation time of the pump 90 may be 11 seconds. For example, when the washing motor is started (on), the pump motor may be started (on), it is stopped (off) after being operated for 11 seconds, and then when the washing motor is started again, the operation pattern of the pump motor described above may be repeated again.

Meanwhile, during heat washing (S12), the pump 90 may be operated at a lower speed than during washing supply water (S11). For example, during heat washing (S12), a current of 0.5 A may be applied to the pump 90.

Heat washing (S12) may be carried out for a longer time (about 8 minutes) than washing water (S11).

The post-washing (S13) is performed in a state in which the operation of the heater 29 is stopped after the heat washing (S12). In the post-washing (S13), a third drum operation in which the drum 32 is rotated at the first drum rotation speed (e.g., 46 rpm) is performed at least once. Operating the pump 29 at the first pump rotation speed is performed at least once during the third drum operation.

In post-washing (S13), a ratio (t32/t31=10/24) of one stop time (t32) to one rotation time (t31) of the drum 32 may be smaller than the value (18/12) during the heat washing (S12). Since the post-washing (S13) is performed in a state in which the operation of the heater 29 is stopped, the operation rate of the washing motor is increased (that is, the ratio of one rotation time of the washing motor is increased) to improve washing power.

A ratio (t41:t42) of a time (t41) for which the pump 90 is rotated once (t41) and a time (t42) for which the pump 90 is stopped once during the post-washing (S13) may be 8:10.

A ratio (t32/t31=10/24) of a stop time (t32) to an operation time (t31) of the drum 32 in the post-washing (S13) may be smaller than the value (18/12) in the heat washing (S12)

The post-washing (S13) may be performed longer (e.g., 43 minutes) than the heat washing (S12).

The first rinsing cycle (S2) may include rinsing and spin-drying (S21) and water supply (S22).

The rinsing and spin-drying step (S21) may be a step of spin-drying laundry by rotating the drum 32 at a preset spin-drying speed. As the laundry rotates while being adhered to the inner surface of the drum 32, spin-drying is performed.

The pump 90 may be operated in an open state of the drain valve. At this time, the pump 90 may be operated in the drain mode to discharge wash water through the drain pipe 19. In the rinsing and spin-drying step (S21), the drum 32 may be accelerated by stages to reach a spin-drying speed. However, the spin-drying speed may be accelerated at a time without being limited thereto. The spin-drying speed is preferably 600 rpm, but is not necessarily limited thereto. The time required for the rinsing and spin-drying (S21) may be approximately 11 minutes.

After the rinsing and spin-drying step (S21), the water supply step (S22) may be performed. In the water supply step (S22), water as much as a second set amount (e.g., 37 liters (l)) is supplied into the tub 31, and in this process, operating the drum 32 at the first drum rotation speed (FIG. 6) (46 rpm in the table of FIG. 6) may be performed at least once.

A ratio (t51:t52) of a time t51 for which the drum 32 is rotated once and a time t52 for which the drum 32 is rotated once during water supply (S22) may be 21:9.

A ratio (t61:t62) of a time t61 for which the pump 90 is rotated once and a time t62 for which the pump 90 is rotated once during water supply (S22) may be 23:12. At this time, the pump 90 may be operated at the first pump rotation speed.

Water supply (S22) may be carried out for about 4 minutes.

The second rinsing cycle (S3) may include rinsing and spin-drying (S31) and water supply (S32). The drum 32 and the pump 90 are operated in substantially the same manner as the rinsing and spin-drying (S31) and the water supply (S22), respectively, in the rinsing and spin-drying (S31) and the water supply (S32). However, the rinsing and spin-drying (S31) is performed for a shorter time (approximately 5 minutes) than the rinsing and spin-drying (S21), and the water supply (S32) may also be performed for a shorter time (approximately 3 minutes) than the water supply (S22). In addition, the amount of water supplied at the time of water supply (S32) may be smaller than that of water supply (S22). For example, 36 liters (l) may be supplied at the time of water supply (S32).

The spin-drying (S4) may include main spin-drying (S41) and unwinding (S42). The main spin-drying (S41) may be a step of spin-drying laundry by rotating the drum 32 at a preset spin-drying speed. As the laundry rotates while being adhered to the inner surface of the drum 32, spin-drying is performed.

The pump 90 may be operated in an open state of the drain valve. At this time, the pump 90 may be operated in the drain mode to discharge wash water through the drain pipe 19. In the main spin-drying (S41), the drum 32 may be accelerated by stages to reach the spin-drying speed. However, the spin-drying speed may be accelerated at a time without being limited thereto. The spin-drying speed is preferably 750 rpm, but is not necessarily limited thereto. A time required for the main spin-drying (S41) may be approximately 13 minutes.

The cloth unwinding (S42) is to untangle the laundry (cloth) that has been completely spin-dried, and the drum 32 may be rotated to induce a tumbling motion. Specifically, the drum 32 may be rotated at the first drum rotation speed. In this case, a ratio (t71:t72) of a time t71 for which the drum 32 is rotated once and a time t72 for which the drum 32 is stopped once may be 7:3. For example, a pattern in which current is applied to the washing motor for 7 seconds and then cut off for 3 seconds may be repeated. The cloth unwinding (S42) may be performed for about 1 minute.

Figure 7:
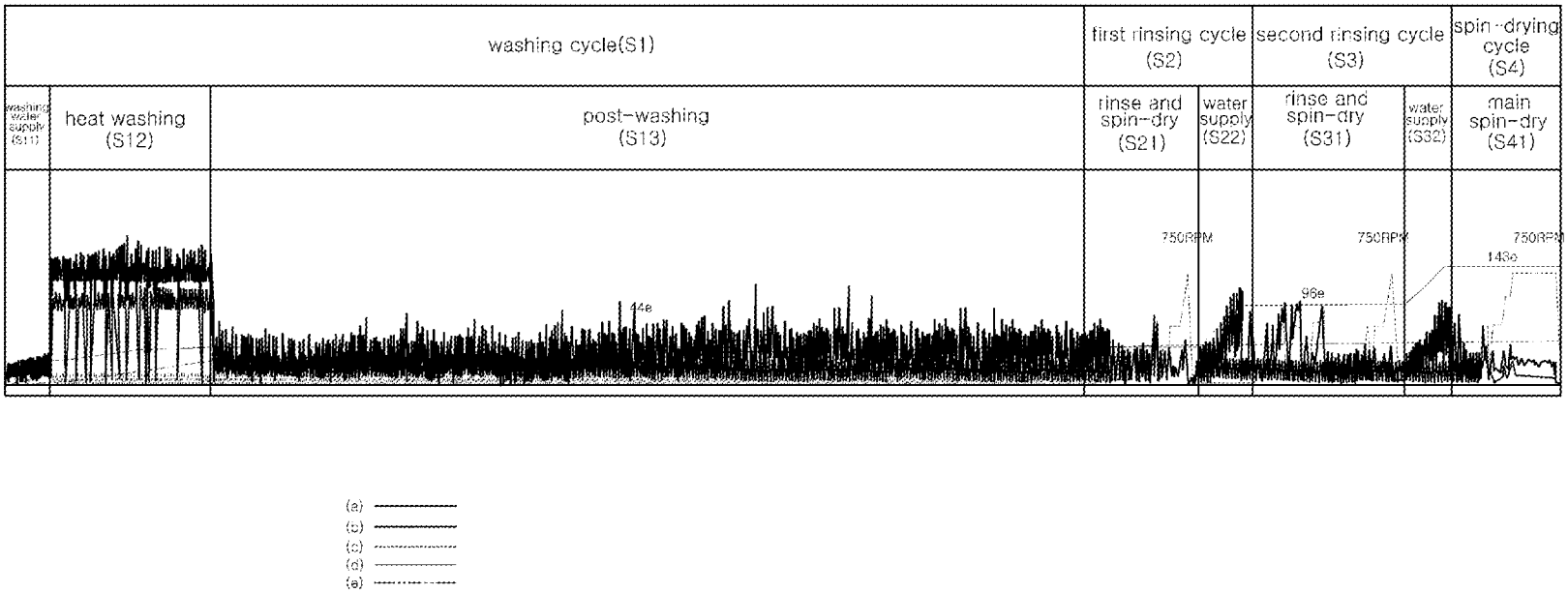
FIG. 7 is graphs referenced to describe a control method of a washing machine according to another embodiment of the present disclosure.

FIG. 7 is graphs referenced to describe a control method (a second washing mode) of a washing machine according to an embodiment of the present disclosure, in which (a) is current (W), (b) is electric power, C is a rotation speed of the drum, (d) is the amount of supplied water, and (e) represents electrical energy (Wh). In particular, the current a, the electric power c, and the electrical energy Wh indicate a total amount consumed by the washing motor, the pump motor, and the heater 29.

FIG. 8 is a table summarizing data referenced to describe a control method (the second washing mode) of a washing machine according to an embodiment of the present disclosure. Hereinafter, a control method of a washing machine according to another embodiment of the present disclosure will be described with reference to FIGS. 7 and 8.

The method for controlling a washing machine according to another embodiment of the present disclosure may include a washing cycle (S1), a first rinsing cycle (S2), a second rinsing cycle (S3), and a spin-drying cycle (S4).

The first washing cycle (S1) may include washing water supply (S11), heat washing (S12), post-washing (S13), and simple rinsing (S14). The washing water supply (S11) is a step of supplying water into the tub 31, in which the water supply valve 33 is opened under the control of a controller (not shown). Water is supplied to the dispenser 35 through the water supply pipe 34, and the additive (detergent) contained in the dispenser 35 may be discharged together with the water.

At the time of washing water supply (S11), a first set amount (e.g., 44 liters (l)) of water is supplied into the tub 31, and a first drum operation is performed while the water is supplied in this manner. During the first drum operation, rotating the drum 32 at a first drum rotation speed (46 rpm in the table of FIG. 6) is performed at least once. Also, while the first drum operation is performed, operating the pump 90 at the first pump rotation speed is performed at least once. When a current of 0.8 A is applied to the pump motor, the pump motor may be rotated at the first pump rotation speed. A time required for the washing water supply (S11) may be approximately 5 minutes.

While the drum 32 is rotated at the first drum rotation speed, the laundry located at the lowest point in the drum 32 may rise to a certain height by the rotation of the drum 32 and may be separated from the inner surface of the drum 32 to fall. Hereinafter, this type of laundry flow is referred to as a tumbling motion.

The rotation of the drum 32 (i.e., rotation at the first drum rotation speed) during the washing water supply (S11) may be repeated a plurality of times. In this case, a ratio (t11:t12) of the time t11 for which the drum 32 is rotated once and the time t12 for which the drum 32 is stopped once may be 7:8.

For example, a pattern in which current is applied to the washing motor for 7 seconds and then cut off for 8 seconds may be repeated.

The rotation of the pump motor may be controlled to be synchronized with the washing motor. That is, the pump motor may be started in response to the starting of the washing motor, and the pump motor may also be stopped in response to the stopping of the washing motor.

Heat washing (S12) may be performed in a state in which the first set amount of water is supplied into the tub 31 by the washing water supply (S11). During heat washing (S12), the heater 29 is operated, and the second drum operation is performed while the heater 29 is operated. In the second drum operation, the drum 32 may be rotated at the same speed (a first drum rotation speed) as in the first drum operation.

During heat washing (S12), a ratio (t22/t21=18/12) of one stop time (t22) to one rotation time (t21) of the drum 32 may be greater than a value (8/7) at the time of washing water supply (S11). Since the heater 29 consumes a large amount of current during heat washing (S12), an operation rate of the washing motor is lowered (that is, a ratio of the one-time stop time of the washing motor is increased) to suppress consumption of total power.

During heat washing (S12), the start of the pump 90 may be controlled to be synchronized with the start of rotation of the drum 32. The one-time operation time of the pump 90 may be 11 seconds. For example, when the washing motor is started (on), the pump motor may be started (on), it is stopped (off) after being operated for 11 seconds, and then when the washing motor is started again, the operation pattern of the pump motor described above may be repeated again.

Meanwhile, during heat washing (S12), the pump 90 may be operated at a lower speed than during washing supply water (S11). For example, during heat washing (S12), a current of 0.5 A may be applied to the pump 90.

Heat washing (S12) may be carried out for longer (about 19 minutes) than washing water (S11). In addition, it may be carried out for a longer time (e.g., 19 minutes) than the heat washing (S12, see FIG. 6) in the embodiment described above with reference to FIGS. 5 and 6 described above.

The post-washing (S13) is performed in a state in which the operation of the heater 29 is stopped after the heat washing (S12). In the post-washing (S13), a third drum operation in which the drum 32 is rotated at the first drum rotation speed (e.g., 46 rpm) is performed at least once. Operating the pump 29 at the first pump rotation speed is performed at least once during the third drum operation.

In post-washing (S13), a ratio (t32/t31=10/16) of one stop time (t32) to one rotation time (t31) of the drum 32 may be smaller than the value (18/12) during the heat washing (S12). Since the post-washing (S13) is performed in a state in which the operation of the heater 29 is stopped, the operation rate of the washing motor is increased (that is, the ratio of one rotation time of the washing motor is increased) to improve washing power.

A ratio (t41:t42) of a time (t41) for which the pump 90 is rotated once (t41) and a time (t42) for which the pump 90 is stopped once during the post-washing (S13) may be 10:9.

A ratio (t32/t31=10/16) of a stop time (t32) to an operation time (t31) of the drum 32 in the post-washing (S13) may be smaller than the value (18/12) in the heat washing (S12)

The post-washing (S13) may be performed longer (e.g., 130 minutes) than the heat washing (S12).

After the post-washing (S13), simple rinsing (S14) may be performed.

Water is fed into the drum 32 so that the laundry may be rinsed. The simple rinsing (S14) may be performed for about 1 minute.

The first rinsing cycle (S2) may include rinsing and spin-drying (S21), water supply (S22), and rinsing (S23).

The rinsing and spin-drying step (S21) may be a step of spin-drying laundry by rotating the drum 32 at a preset spin-drying speed. As the laundry rotates while being adhered to the inner surface of the drum 32, spin-drying is performed.

The pump 90 may be operated in an open state of the drain valve. At this time, the pump 90 may be operated in the drain mode to discharge wash water through the drain pipe 19. In the rinsing and spin-drying step (S21), the drum 32 may be accelerated by stages to reach a spin-drying speed. However, the spin-drying speed may be accelerated at a time without being limited thereto. The spin-drying speed is preferably 750 rpm, but is not necessarily limited thereto. The time required for the rinsing and spin-drying (S21) may be approximately 9 minutes.

After the rinsing and spin-drying step (S21), the water supply step (S22) may be performed. In the water supply step (S22), water as much as a second set amount (e.g., 52 liters (l)) is supplied into the tub 31, and in this process, operating the drum 32 at the first drum rotation speed (FIG. 8) (46 rpm in the table of FIG. 6) may be performed at least once.

A ratio (t51:t52) of a time t51 for which the drum 32 is rotated once and a time t52 for which the drum 32 is rotated once during water supply (S22) may be 21:9.

A ratio (t61:t62) of a time t61 for which the pump 90 is rotated once and a time t62 for which the pump 90 is rotated once during water supply (S22) may be 23:12. At this time, the pump 90 may be operated at the first pump rotation speed.

Water supply (S22) may be carried out for about 6 minutes.

After water supply (S22), rinsing (S23) may be performed. Water is fed into the drum 32 so that the laundry may be rinsed. The rinsing (S22) may be performed for about 1 minute.

A ratio (t71:t72) of a time t71 for which the drum 32 is rotated once and a time t72 for which the drum 32 is rotated once during rinsing (S23) may be 3:8.

A ratio (t81:t82) of a time t81 for which the pump 90 is rotated once and a time t82 for which the pump 90 is rotated once during rinsing (S23) may be 23:12. At this time, the pump 90 may be operated at the first pump rotation speed.

The second rinsing cycle (S3) may include rinsing and spin-drying (S31), water supply (S32), and rinsing (S33). The rinsing and spin-drying (S31), water supply (S32), and rinsing (S33) are performed by the drum 32 and the pump 90 in substantially the same manner as the aforementioned rinsing and spin-drying (S21), water supply (S22), and rinsing (S23), respectively. However, the rinsing and spin-drying (S31) may be performed for a shorter time (approximately 5 minutes) than the rinsing and spin-drying (S21), and the amount of water supplied at the time of water supply (S32) may be smaller than that of the water supply (S22). For example, 47 liters (l) may be supplied during the water supply (S32).

The spin-drying process (S4) may include main spin-drying (S41) and cloth unwinding (S42). The main spin-drying (S41) may be a step of spin-drying laundry by rotating the drum 32 at a preset spin-drying speed. As the laundry rotates while being adhered to the inner surface of the drum 32, spin-drying is performed.

The pump 90 may be operated in a state in which the drain valve is opened. At this time, the pump 90 may be operated in the drain mode to discharge the wash water through the drain pipe 19. In the main spin-drying (S41), the drum 32 may be accelerated by stages to reach the spin-drying speed. However, the spin-drying speed may be accelerated at a time without being limited thereto. The spin-drying speed is preferably 750 rpm, but is not necessarily limited thereto. A time required for the main spin-drying (S41) may be approximately 15 minutes.

The cloth unwinding (S42) is to untangle the laundry (cloth) that has been completely spin-dried, and the drum 32 may be rotated to induce a tumbling motion. Specifically, the drum 32 may be rotated at the third drum rotation speed. In this case, a ratio (t81:t82) of a time t81 for which the drum 32 is rotated once and a time t82 for which the drum 32 is stopped once may be 7:3. For example, a pattern in which current is applied to the washing motor for 7 seconds and then cut off for 3 seconds may be repeated. The cloth unwinding (S42) may be performed for about 1 minute.

What is claimed is:

1. A washing machine comprising:

a tub configured to store water;

a drum rotatably provided in the tub;

a driving unit configured to rotate the drum;

a water supply unit configured to supply water supplied from an external water source to the tub;

a pump having a pump motor, the pump being configured to pressure-feed water discharged from the tub;

a nozzle configured to spray the water that is pressure-fed by the pump into the drum;

a heater configured to heat the water in the tub; and a controller configured to control the driving unit, the water supply unit, the pump motor, and the heater, wherein the controller is configured to:

control the water supply unit to supply water by a first set amount to the tub, control the driving unit to rotate the drum while water is being supplied, rotate the pump motor during the rotation of the drum, operate the heater in a state in which the first set amount of water is supplied to the tub, control the driving unit to rotate the drum during the operation of the heater, operate the pump motor during the rotation of the drum and the operation of the heater, stop the operation of the heater, control the driving unit to rotate the drum in a state in which the operation of the heater is stopped, and rotate the pump motor during the rotation of the drum in a state in which the operation of the heater is stopped, and wherein a ratio of a stop time of the drum to a rotation time of the drum when the heater is operated is greater than a ratio of a stop time of the drum to a rotation time of the drum when water is supplied to the tub.

2. The washing machine of claim 1, wherein the driving unit is configured to rotate the drum (i) at a first drum rotation speed while water is supplied to the tub, (i) at a second drum rotation speed during the operation of the heater, and (ii) at a third drum rotation speed in the state in which the operation of the heater is stopped, and wherein the first drum rotation speed, the second drum rotation speed, and the third drum rotation speed are equal to one another.

3. The washing machine of claim 1, wherein the water supply unit includes:

a water supply pipe configured to receive water from an external water source;

a water supply valve configured to control the water supply pipe; and a dispenser configured to accommodate a detergent and connected to the water supply pipe and the tub, and wherein the controller is configured to, based on supplying the first set amount of water to the tub, control the water supply valve to supply water supplied to the water supply pipe to the tub via the dispenser.

4. The washing machine of claim 1, wherein the controller is configured to, based on supplying water to the tub, rotate the drum at least once, rotate the pump motor at least once, and control rotation of the pump motor and rotation of the drum to be synchronized with each other.

5. The washing machine of claim 1, wherein the controller is configured to control starting of the pump motor to be synchronized with starting of rotation of the drum, when operating the heater.

6. The washing machine of claim 1, wherein the driving unit is configured to rotate the drum (i) at a first drum rotation speed while water is being supplied, (ii) at a second drum rotation speed during the operation of the heater, and (iii) at a third drum rotation speed in the state in which the operation of the heater is stopped, and wherein the first, second, and third drum rotation speeds are speeds at which laundry located at the lowest point in the drum rises to a certain height by rotation of the drum and then falls apart from an inner surface of the drum.

7. The washing machine of claim 1, wherein a ratio of a stop time to a rotation time of the drum in a state in which the heater is stopped is smaller than the ratio of the stop time to the rotation time of the drum when the heater is operated.

8. The washing machine of claim 1, wherein the controller is configured to control a rotation time of the drum based on a detected amount of laundry introduced into the drum.

9. The washing machine of claim 8, wherein the controller is configured to:

based on the detected amount of the laundry being a first laundry amount, rotate the drum for a first drum driving time during the operation of the heater; and based on the detected amount of the laundry being a second laundry amount that is greater than the first laundry amount, rotate the drum for a second drum driving time that is greater than the first drum driving time during the operation of the heater.

10. The washing machine of claim 8, wherein the controller is configured to:

based on the detected amount of the laundry being a first laundry amount, rotate the pump motor for a first pump driving time while the operation of the heater is stopped; and based on the detected amount of the laundry being a second laundry amount that is greater than the first laundry amount, rotate the pump motor for a second pump driving time that is greater than the first pump driving time.

11. The washing machine of claim 10, wherein the controller is configured to:

control the driving unit such that a ratio of a stop time of the drum to a rotation time of the drum in a state in which the operation of the heater is stopped when the detected amount of the laundry is the second laundry amount is greater than a ratio of a stop time of the drum to a rotation time of the drum in a state in which the operation of the heater is stopped when the detected amount of the laundry is the first laundry amount.

12. The washing machine of claim 1, wherein the controller is configured to rotate the pump motor (i) at a first pump rotation speed during the rotation of the drum while water is being supplied and (ii) at a second pump rotation speed during the operation of the heater, and wherein the second pump rotation speed is less than the first pump rotation speed.

13. The washing machine of claim 12, wherein the controller is configured to rotate the pump motor at a third pump rotation speed in the state in which the operation of the heater is stopped, and wherein the third pump rotation speed is equal to the first pump rotation speed.

14. A control method of a washing machine including a drum rotating about a horizontal rotation axis in a tub and a plurality of nozzles spraying water discharged from the tub and circulated by a pump into the drum, wherein the control method comprising:

(a) step of performing a first drum operation of supplying water by a first set amount together with a detergent into the tub and rotating the drum at a first drum rotation speed, while water is supplied, at least once and operating the pump at a first pump rotation speed at least once during the first drum operation;

(b) step of operating a heater to heat water in the tub, performing a second drum operation of rotating the drum at the first drum rotation speed during the operation of the heater at least once, and operating the pump at a second pump rotation speed at least once during the second drum operation, wherein the second pump rotation speed is less than the first pump rotation speed; and (c) step of stopping the operation of the heater, performing a third drum operation of rotating the drum at the first drum rotation speed at least once, and operating the pump at the first pump rotation speed at least once during the third drum operation, wherein a ratio of a stop time of the drum to an operation time of the drum in step (b) is greater than a ratio of a stop time of the drum to an operation time of the drum in step (a).

15. The control method of claim 14, wherein, in step (a), the operation of the pump is controlled to be synchronized with the rotation of the drum.

16. The control method of claim 14, wherein, in step (b), starting of the pump is controlled to be synchronized with starting of the rotation of the drum.

17. The control method of claim 14, wherein, while the drum is rotated at the first drum rotation speed, laundry located at the lowest point in the drum rises to a certain height by the rotation of the drum and then is separated from an inner surface of the drum and falls.

18. The control method of claim 14, wherein a ratio of a stop time of the drum to an operation time of the drum in step (c) is smaller than the ratio of the stop time of the drum to the operation time in step (b).

19. A control method of a washing machine including a drum rotating about a horizontal rotation axis in a tub and a plurality of nozzles spraying water discharged from the tub and circulated by a pump into the drum, wherein the control method comprising:

(a) detecting an amount of laundry introduced into the drum; and (b) performing a first washing mode when the detected amount of the laundry is a first laundry amount, and performing a second washing mode when the detected amount of the laundry is a second laundry amount, wherein the first washing mode includes:

(c-1) a step of supplying water by a first set amount together with a detergent into the tub, performing a first drum operation of rotating the drum at a first drum rotation speed, while water is supplied, at least once, and operating the pump at a first pump rotation speed at least once during the first drum operation;

(c-2) a step of operating a heater to heat water in the tub, performing a second drum operation of rotating the drum at the first drum rotation speed at least once during the operation of the heater, and operating the pump at a second pump rotation speed during the second drum operation, wherein the second pump rotation speed is less than the first pump rotation speed; and (c-3) a step of performing a third drum operation of rotating the drum at the first drum rotation speed at least once and operating the pump at the first pump rotation speed at least once during the second drum operation, and the second washing mode includes:

(d-1) a step of supplying water by a first set amount together with a detergent into the tub, performing a first drum operation of rotating the drum at the first drum rotation speed at least once, while water is supplied, and operating the pump at the first pump rotation speed at least once during the first drum operation;

(d-2) a step of operating the heater to heat water in the tub, performing a second drum operation of rotating the drum at the first drum rotation speed at least once during the operation of the heater, and operating the pump at the second pump rotation speed at least once during the second drum operation, for a time longer than (c-2); and (d-3) a step of stopping the operation of the heater, performing a third drum operation of rotating the drum at the first drum rotation speed at least once, and operating the pump at the first pump rotation speed at least once during the second drum operation, for a time longer than that in step (c-3), wherein a ratio of a stop time of the drum to a rotation time of the drum in step (d-3) is greater than a ratio of a stop time of the drum to a rotation time of the drum in step (c-3).

* * * * *